US005373614A

United States Patent [19]

Bertschinger

[11] Patent Number: 5,373,614

[45] Date of Patent: Dec. 20, 1994

[54] CLAMPING DEVICE FOR A YARN LAYER AND USE THEREOF

[75] Inventor: Hansjorg Bertschinger, Schwerzenbach, Switzerland

[73] Assignee: Zellweger Uster AG, Uster, Switzerland

[21] Appl. No.: 50,257

[22] PCT Filed: Sep. 11, 1992

[86] PCT No.: PCT/CH92/00186

§ 371 Date: May 12, 1993

§ 102(e) Date: May 12, 1993

[87] PCT Pub. No.: WO93/06282

PCT Pub. Date: Apr. 1, 1993

[30] Foreign Application Priority Data

Sep. 17, 1991 [CH] Switzerland ..... 2741/91

[51] Int. Cl.[5] ..... B65H 67/00

[52] U.S. Cl. ..... 28/201; 28/212

[58] Field of Search ..... 28/193, 194, 195, 196, 28/198, 199, 201, 202, 203.1, 204, 208, 212, 172.1

[56] References Cited

U.S. PATENT DOCUMENTS

| | | | |
|---|---|---|---|
| 2,972,796 | 2/1961 | Block | 28/196 |
| 3,741,836 | 6/1973 | Williams . | |
| 4,409,710 | 10/1983 | Kofler | 28/196 |
| 4,420,861 | 12/1983 | Kofler | 28/196 |
| 5,032,214 | 7/1991 | Kile . | |
| 5,109,582 | 5/1992 | Okuda | 28/196 |

FOREIGN PATENT DOCUMENTS

| | | |
|---|---|---|
| 1203233 | 1/1960 | France . |
| 159499 | 3/1904 | Germany . |

*Primary Examiner*—Clifford D. Crowder
*Assistant Examiner*—Larry D. Worrell, Jr.
*Attorney, Agent, or Firm*—Burns, Doane, Swecker & Mathis

[57] ABSTRACT

A clamping device for clamping a yarn layer includes a clamping rail, a clamping comb that is insertable into the yarn layer, and a reed comb that is also insertable into the yarn layer. The clamping comb is provided with spaced apart clamping lamellae which each have a clamping edge facing the clamping rail for clamping yarn between the clamping rail and the clamping edge of the clamping lamellae. At least one of the clamping rail and the clamping comb are adjustable relative to the other so that the clamping rail and the clamping comb approach one another to clamp the yarn. The reed comb and the clamping comb are longitudinally adjustable relative to one another by an amount greater than the spacing between the adjacent lamellae of the clamping comb in order to deflect the yarn. A method of clamping a warp-yarn layer through use of such a clamping device includes positioning the clamping device on one side of a warp-yarn layer having a plurality of yarns, and moving the clamping device towards the warp-yarn layer to insert the clamping comb and the reed comb into the warp-yarn layer. The clamping device is moved while a clamping gap exists between the clamping rail and the clamping edges. Relative longitudinal movement is then initiated between the reed comb and the clamping comb to deflect the yarns of the warp-yarn layer so that the yarns cross the clamping edges of a plurality of adjacent lamellae. Thereafter, the clamping gap is closed to clamp the deflected yarn.

13 Claims, 2 Drawing Sheets

CLAMPING DEVICE FOR A YARN LAYER AND USE THEREOF

FIELD OF THE INVENTION

The present invention relates to a clamping device for a sheet-like yarn layer, with a fixed clamping rail and with a clamping member adjustable relative to the latter.

BACKGROUND OF THE INVENTION

Clamping devices of this type are used, for example, in warp-yarn drawing in machines and in warp tying-in machines for clamping the warp yarns. They consist, as a rule, of a clamping rail extending over the entire width of the warp and of a rod-shaped clamping comb which is held in the clamping rail or on the latter and which is pressed into the clamping rail from above and then interlocked with this. During stripping off after the tie-in, the clamping rail or the clamping comb has to be drawn out laterally after the clamping has been released.

When this clamping device is to be used during the warp change on the weaving machine, the lateral moving out of the clamping comb and/or of the clamping rail then becomes very complicated, if only for reasons of space. Moreover, the clamping rail would also have to be provided in a suitable way at the clamping point, for which purpose either a lateral pushing in before the clamping or a permanent arrangement on the weaving machine would be necessary.

The former has the disadvantages already mentioned with regard to the clamping comb, and the permanent arrangement on the weaving machine would lead to an unacceptable contamination of the clamping rail with dirt and dust. Furthermore, the permanent arrangement of the clamping rail on the weaving machine would entail appreciable additional costs.

Now if we conceive the idea of going a further step and imagine automating the warp change in any way or at least developing it further towards automation, then it becomes clear that a development of this kind would be greatly impeded by the known clamping devices, particularly because the lateral moving in or out of the clamping rail or clamping comb is extremely difficult to automate.

SUMMARY OF THE INVENTION

Now the invention is to provide a clamping device of the type mentioned in the introduction, the handling of which is substantially simpler and also easier to automate than in the known devices mentioned above.

This object is achieved, according to the invention, in that the clamping member contains a clamping comb insertable into the yarn layer and having clamping lamellae which have a clamping edge assigned to the clamping rail. A reed comb which is insertable into the yarn layer is also provided, and the reed comb and the clamping comb are longitudinally adjustable relative to one another. The adjustment travel amounts to a multiple of the division of the lamellae of one of the combs.

The invention therefore proposes a one-sided clamping device, that is to say one in which only one side of the yarn layer need be accessible. This is in contrast to the known clamping devices, in which the clamping rail and clamping comb are arranged on both sides of the yarn layer in their initial position. This one-sided clamping device contains, on the one hand, a fixed clamping rail and, on the other hand, the clamping comb being adjustable relative to the latter and insertable into the yarn layer.

A preferred embodiment of the clamping device according to the invention is characterised in that the clamping comb is made fixed and the reed comb is made longitudinally adjustable, and in that the adjustment travel of the latter amounts to more than double the division of the clamping lamellae.

A clamping gap is formed between the clamping lamellae and the clamping rail in the so-called insertion position. When the clamping comb is inserted into the yarn layer, the yarns of the yarn layer which are oriented parallel to the clamping lamellae lie on the clamping rail. The reed comb, likewise inserted into the yarn layer, is then displaced approximately 10 to 20 millimeters in the longitudinal direction of the clamping comb. The yarns are thereby deflected at the clamping lamellae and are drawn laterally into the clamping gap formed between each clamping lamella and the clamping rail. The actual clamping then takes place as a result of the closing of the clamping gap.

Thus, since during clamping operation, the clamping device merely needs to be laid against the yarn layer and subsequently controlled appropriately for the movements of the reed comb and clamping rail, simpler handling and greater ease of automation than in the known clamping devices are obtained. The clamping device according to the invention can be mounted on a robot-like mechanically drivable and controllable carrier which has the driving means necessary for achieving the required movements.

The invention relates further to a use of the clamping device for clamping a warp-yarn layer.

This use includes carrying out the following steps:

a. positioning of the clamping device on one side of the yarn layer;
b. movement of the clamping device, with an open clamping gap, towards the yarn layer and insertion of the clamping comb and of the reed comb into the latter;
c. adjustment of the reed comb in the longitudinal direction of the clamping comb and deflection of the yarns of the yarn layer, so that these cross the clamping edges of a plurality of adjacent clamping lamellae;
d. closing of the clamping gap.

BRIEF DESCRIPTION OF THE DRAWING FIGURES

The invention is explained in more detail below by means of an exemplary embodiment and the drawings, in which.

Figure 4B:
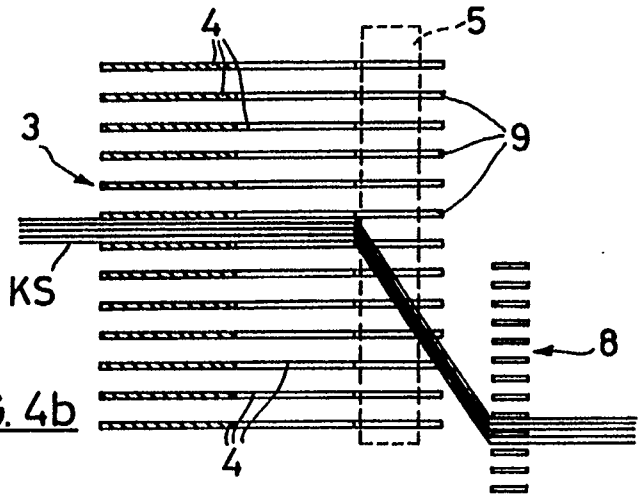
Figure 4A:
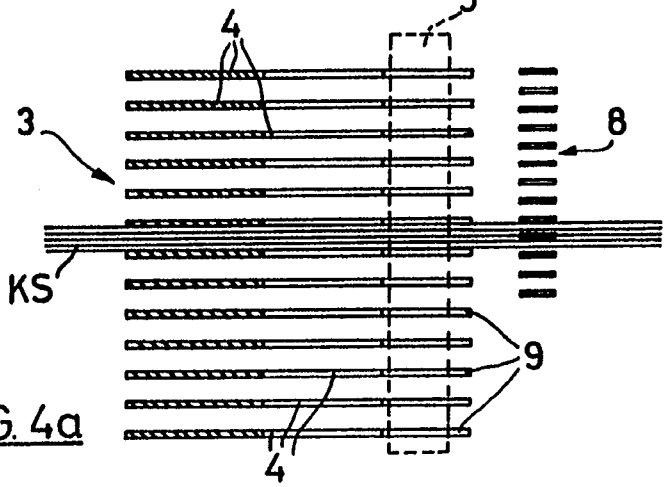

FIGS. 4*a* and 4*b* show diagrams to explain the functioning on an enlarged scale.

DETAILED DESCRIPTION OF THE INVENTION

Figure 1:
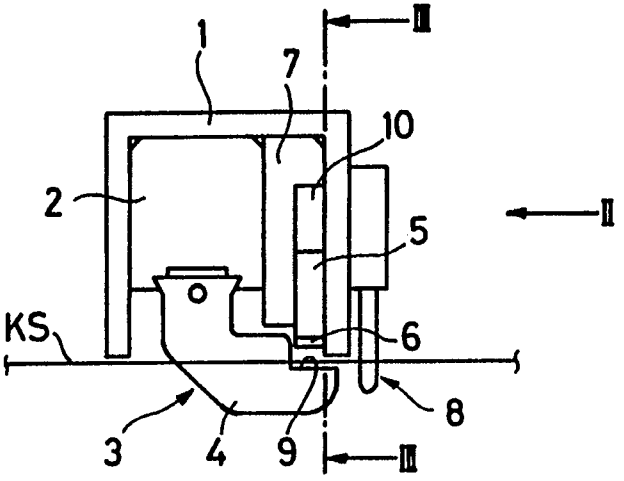
FIG. 1 shows a side view of a clamping device according to the invention for a warp-yarn layer, as seen transversely to the direction of the warp yarns.
Figure 2:
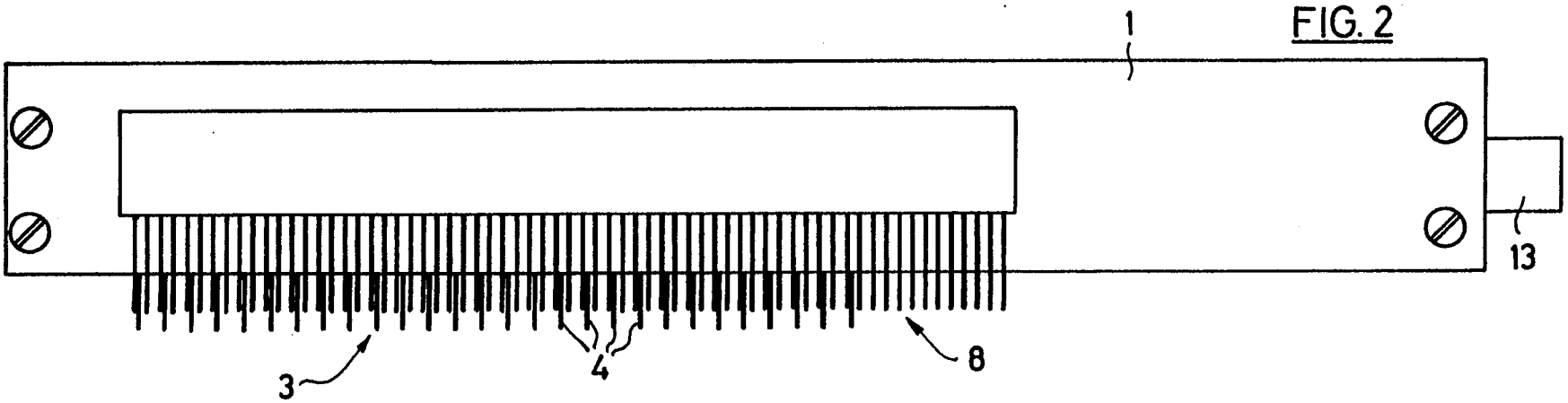
FIG. 2 shows a view in the direction of the arrow II of FIG. 1.
Figure 3:
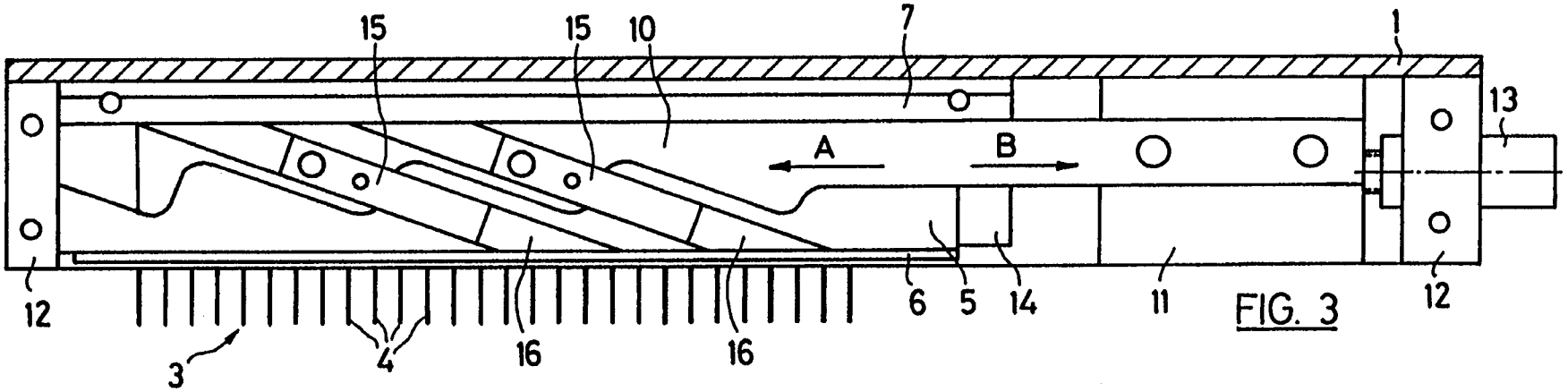
FIG. 3 shows a section along the line III—III of FIG. 1.

FIG. 1 shows a clamping device according to the invention positioned above a warp-yarn layer KS; the warp-yarn layer is not shown in FIGS. 2 and 3. As illustrated, the clamping device consists of a U-shaped sectional carrier 1; a clamping comb 3 which is fastened in the latter via a mounting 2 and which is formed by clamping lamellae 4 arranged on the mounting 2; a clamping rail 5 which is adjustable in the vertical direction and which is provided, on its edge facing the clamping lamellae 4, with a coating 6 consisting of an elastic material, for example rubber; of an adjusting mechanism, evident from FIG. 3, for the clamping rail 5; a guide 7 supporting this adjusting mechanism and the clamping rail 5; and a reed comb 8 arranged on the outside of the sectional carrier 1 so as to be displaceable in the longitudinal direction of the latter.

The clamping lamellae 4 have an approximately L-shaped form and are made to project towards the clamping rail 5 from their foot part fastened on the mounting 2. In the region of the clamping rail 5, they are provided with a step, one edge 9 of which extends parallel to the warp-yarn layer KS and acts as a clamping edge. Between the clamping edges 9 of the individual clamping lamellae 4 and the clamping rail 5 is formed a clamping gap which can be closed and opened by adjusting the clamping rail 5 in the vertical direction towards and away from the clamping edges 9.

The reed comb 8, the adjusting mechanism of which is not shown, is made so that the tips of its teeth project beyond the sectional carrier 1 and the clamping edges 9. When the clamping device is inserted into the warp-yarn layer KS, as in FIG. 1, the warp yarns bear against the end edges of the side faces of the sectional carrier 1 and extend from the tooth spaces of the clamping comb 3 through the open clamping gap between the clamping rail 5 and the clamping edges 9 of the clamping lamellae 4 to the tooth spaces of the reed comb 8. The division spacing between the teeth of the reed comb 8 is selected somewhat smaller than that of the clamping lamellae 4 of the clamping comb 3, but is variable within wide limits.

The function of the reed comb 8 is evident from FIGS. 4*a* and 4*b*, FIG. 4*a* showing the initial position after insertion into the warp-yarn layer KS and FIG. 4*b* the clamping position immediately before and during the clamping. As can be assumed from FIG. 4*b*, the reed comb 8 is displaced in the longitudinal direction of the clamping comb 3 over a particular distance, the length of which amounts to a multiple of the division of or spacing between the clamping lamellae 4. In the exemplary embodiment illustrated, the division of or spacing between the clamping lamellae 4 amounts to approximately 2.5 mm and the adjustment travel of the reed comb to approximately 17 mm. However, the latter is variable within wide limits. It is essential, to achieve the desired result, that the individual warp yarns be deflected at the vertical edge, adjoining the clamping edge 9, of the clamping lamellae 4 to such an extent that they cross the clamping edges 9 of a plurality of adjacent clamping lamellae 4. When the clamping rail 5 is moved towards the clamping edges 9 and the clamping gap is thereby closed, each warp yarn is clamped fast at a plurality of points. This guarantees a reliable clamping.

As can be assumed from FIG. 3, the clamping rail 5, its longitudinal edge facing away from the clamping lamellae 4, is provided with a toothing and is in engagement by means of the latter with a toothed rail 10 which is fastened to a holding block 11 guided in the sectional carrier 1 so as to be longitudinally displaceable. The sectional carrier 1 is closed off on its end faces by means of retaining plates 12 (these retaining plates 12 are omitted in FIG. 1 for the sake of greater clarity). Mounted in the retaining plate 12 located on the right in FIG. 3 is a spindle 13, during the rotation of which the holding block 11 and consequently the toothed rail 10 fastened to this is displaced in the sectional carrier 1. The toothed rail and the clamping rail 5 slide, with their side face turned towards the observer in FIG. 3, along the inner face of the side wall of the sectional carrier 1, the side wall being located on the right in FIG. 1. Its other side face is guided on the plate-shaped guide 7 (FIG. 1). The latter has, at its end facing the holding block 11, a step 14 which serves as a stop for the clamping rail 5.

To adjust the clamping rail 5 towards the clamping edges 9 of the clamping lamellae 4 for the purpose of clamping the yarns of the yarn layer, the holding block 11 together with the toothed rail 10, is pushed to the left in the direction of the arrow A. To release the clamping, the holding block 11 together with the toothed rail 10 is pushed correspondingly to the right in the opposite direction (arrow B). So that the clamping rail 5 is reliably moved back again into the initial position, illustrated in FIGS. 1 and 3, in which the clamping gap is open, there are fastened in grooves of the toothed rail 10 guide rails 15 which project beyond the toothed rails 10 and which are guided in the manner of a sliding block in corresponding grooves 16 of the clamping rail 5. Of course, other means, such as, for example, springs or the like, could also be used for this function.

The one-sided clamping device described can be employed particularly in the so-called warp preparation. That is to say during the drawing-in and during the tying-in of warps. The one-sided clamping device shows itself to be superior to the conventional two-sided clamping devices, especially in the case of confined conditions of space, such as occur, for example, during use on the weaving machine.

As the description of the clamping device shows, its use and operation require only a few manipulations, specifically:

positioning on the respective yarn layer KS
adjustment of the reed comb 8
actuation of the spindle 13.

These manipulations can be automated in a simple way, so that the clamping device according to the invention therefore makes it possible to take a substantial step towards rationalisation and automation in the drawing-in and tying-in of warps.

What is claimed is:

1. Clamping device for a yarn layer, comprising a clamping rail, a clamping comb insertable into the yarn layer and having spaced apart clamping lamellae, at least one of the clamping rail and the clamping comb being adjustable relative to the other so that the clamping rail and the clamping comb approach one another, the clamping lamellae having a clamping edge facing the clamping rail for clamping yarn between the clamping rail and the clamping edge of the clamping lamellae, a reed comb insertable into the yarn layer, the reed comb and the clamping comb being longitudinally adjustable relative to one another by an amount greater than the spacing between adjacent lamellae of the clamping comb to deflect the yarn.

2. Clamping device according to claim 1, wherein the clamping comb is fixed and the reed comb is longitudinally adjustable, the reed comb being adjustable relative to the clamping comb by an amount greater than twice the distance between adjacent clamping lamellae.

3. Clamping device according to claim 2, wherein the reed comb is positionable relative to the clamping rail to form a clamping gap between the clamping rail and the clamping edges of the clamping lamellae, and including means for positioning the yarn layer level with the clamping gap.

4. Clamping device according to claim 3, wherein the clamping rail and the clamping comb are carried on a common carrier, and said means for positioning the yarn layer being provided on the common carrier.

5. Clamping device according to claim 4, wherein the reed comb is arranged on the common carrier, the reed comb including a plurality of teeth which each have a free end, the free ends of the teeth of the reed comb projecting beyond the clamping edges of the clamping lamellae.

6. Clamping device according to claim 5, wherein the clamping lamellae have, adjoining the clamping edge, a deflecting edge extending at an inclination relative to the clamping edge.

7. Clamping device according to claim 2, wherein the yarn layer includes a plurality of yams which are guided substantially rectilinearly after the insertion of the clamping comb and reed comb into the yarn layer, the yarns being deflected out of the rectilinear direction during the adjustment of the reed comb.

8. Clamping device according to claim 7, wherein the yarns cross the clamping edges of a plurality of adjacent clamping lamellae when the yarns are deflected.

9. Clamping device according to claim 7, wherein the clamping rail possesses an edge facing away from the clamping edges of the clamping lamellae, said edge of the clamping rail being provided with a toothed profile which engages a toothed rail that is displaceable in the longitudinal direction.

10. Method of clamping a warp-yarn layer through use of a clamping device that includes a carrier, a clamping rail mounted on the carrier, a clamping comb mounted on the carrier and a reed comb mounted on the carrier, the clamping comb having a plurality of clamping lamellae which each possess a clamping edge, the method comprising the steps of:

positioning the clamping device on one side of a warp-yarn layer having a plurality of yarns;

moving the clamping device towards the warp-yarn layer to insert the clamping comb and the reed comb into the warp-yarn layer, the clamping device being moved while a clamping gap exists between the clamping rail and the clamping edges;

initiating relative longitudinal movement between the reed comb and the clamping comb to deflect the yarns of the warp-yarn layer so that the yarns cross the clamping edges of a plurality of adjacent lamellae; and closing the clamping gap to clamp the deflected yarns.

11. Method according to claim 10, wherein the clamping device includes a toothed rail mounted on a carrier, said clamping rail being mounted on the carrier and engaging the toothed rail, and including moving the toothed rail to close the clamping gap.

12. Method according to claim 10, wherein said step of initiating relative longitudinal movement between the reed comb and the clamping comb includes moving the reed comb relative to the clamping comb by an amount greater than the spacing between adjacent lamellae.

13. Method according to claim 10, wherein said step of initiating relative longitudinal movement between the reed comb and the clamping comb includes moving the reed comb relative to the clamping comb by an amount greater than twice the spacing between adjacent lamellae.

* * * * *